United States Patent [19]

Forster

[11] 4,449,444

[45] May 22, 1984

[54] AXIAL PISTON PUMPS

[75] Inventor: Franz Forster, Muhlbach, Fed. Rep. of Germany

[73] Assignee: Linde Aktiengesellschaft, Hollriegelskreuth, Fed. Rep. of Germany

[21] Appl. No.: 282,757

[22] Filed: Jul. 13, 1981

[30] Foreign Application Priority Data

Jul. 15, 1980 [DE] Fed. Rep. of Germany ..... 3026765

[51] Int. Cl.[3] ..... F01B 13/04; F04B 1/26

[52] U.S. Cl. ..... 91/506; 417/222

[58] Field of Search ..... 91/504–506, 91/499; 417/222

[56] References Cited

U.S. PATENT DOCUMENTS

| | | | |
|---|---|---|---|
| 1,714,148 | 5/1929 | Weldy | 91/505 |
| 2,445,281 | 7/1948 | Rystrom | 103/162 |
| 2,520,632 | 8/1950 | Greenhut | 103/162 |
| 4,223,594 | 9/1980 | Gherner | 91/504 |

FOREIGN PATENT DOCUMENTS

| | | | |
|---|---|---|---|
| 1129828 | 7/1962 | Fed. Rep. of Germany . | |
| 1625073 | 1/1970 | Fed. Rep. of Germany . | |
| 2451380 | 5/1976 | Fed. Rep. of Germany | 91/506 |
| 1340850 | 9/1963 | France . | |
| 1415392 | 9/1965 | France . | |
| 1073216 | 6/1947 | United Kingdom . | |
| 1006852 | 10/1962 | United Kingdom | 91/499 |
| 1176621 | 1/1970 | United Kingdom . | |
| 804858 | 2/1981 | U.S.S.R. | 91/499 |

*Primary Examiner*—William L. Freeh

*Attorney, Agent, or Firm*—Buell, Blenko, Ziesenheim & Beck

[57] ABSTRACT

An axial piston pump is provided for producing two output streams that can be regulated independently of each other with respect to size and pressure. A pump according to the invention includes a housing, a revolving cylindrical drum in said housing, a drive shaft connected to said drum for rotating the same, a plurality of spaced holes in said drum on two different pitch diameters generally parallel to the drum axis and opening to a common end face of said drum, a plurality of pistons reciprocable in said holes, a rotary slide control valve acting on the opposite end face of said drum, a first tapered washer or swash plate bearing on one end of said pistons moving in the holes of the smaller pitch diameter, a second tapered washer or swash plate surrounding the first tapered washer and bearing on one end of the pistons moving in the holes of larger pitch diameter, means engaging said first and second tapered washers independently to move them relatively to one another at an angle to the axis of the drum and a pair of separate outlet ports on said rotary valve receiving fluid independently from each of the pistons of different pitch diameter and delivering the same from the pump.

7 Claims, 3 Drawing Figures

AXIAL PISTON PUMPS

This invention relates to axial piston pumps and particularly to an axial position pump for producing two output streams which can be independently regulated both as to size and pressure.

In order to solve the problem of producing two separate, independently adjustable feed streams with axial piston pumps according to the tapered washer principle, two independent pumps have been used to date. In one design they are flanged on the housing of a separate intermediate gear drive. This construction is very expensive and requires a very large space. The arrangement of axial piston engines, in which a free shaft end is available on the side opposite the drive side, one behind the other in tandem arrangement, flanged directly to each other, is also known. This arrangement is admittedly less expensive, but requires a very large space in the axial direction.

The arrangement of two axial piston pumps in drive-flange construction in a common housing is also known. However, the space required for the swiveling cylindrical drums is very large, such that the housing and thus the internal space required for such pumps becomes very great. The arrangement of two axial piston machines in tapered washer or swash plate construction with cylindrical drum axes arranged parallel to each other in a common housing and supporting the pistons against a common tapered washer body are also already known. Structural components are indeed saved as a result of the common tapered washer swiveling body, but it is no longer possible to regulate the two feed steams produced by the two pumps independently of each other. In order to produce two feed streams, where the sum of these two streams and the magnitude of the two streams relative to each other are adjustable, the arrangement of an additional separating web, which can be displaced over the length of the channel, in the semi-circular channel, at least on the delivery side, where each of the two sections of the at least approximately semi-circular channel lying on both sides of the displaceable separating web is connected to a delivery line, is also already known. This arrangement has the disadvantage that the additional separating web, whose width has to be greater than the mouth of a cylindrical opening in the front wall of the cylindrical drum if it does not lie precisely in the middle of the semi-circular channel, lies in a zone in which the pistons traverse a relatively long path per degree of angle and thus expel a great deal of fluid out of the cylinder per degree of angle/revolution of the cylindrical drum. This leads to losses and noise.

The present invention provides an axial piston pump capable of producing two separate independently adjustable output streams which can be produced with as few components as possible and thus with a low construction expense and which also has relatively small dimensions, especially in the axial direction, and requires a correspondingly small installation space.

In order to accomplish this the present invention provides an axial piston pump for producing two streams that can be regulated independently of each other with respect to size and pressure comprising a revolving cylindrical drum, a drive shaft connected to said drum for rotating the same, a plurality of spaced holes in said drum on two different pitch diameters generally parallel to the drum axis and opening to a common end face of said drum, a plurality of pistons reciprocable in said holes, a rotary slide control valve acting on the opposite end face of said drum, a first tapered washer or swash plate bearing on one end of each of the pistons moving in the holes of the smaller pitch diameter, a second tapered washer or swash plate surrounding the first tapered washer and bearing on one end of the pistons moving in the holes of larger pitch diameters, means engaging said first and second tapered washers independently to move them relatively to one another and a pair of separate outlet ports on said rotary valve receiving fluid independently from each of the pistons in the holes on the small pitch diameter and delivering the same from said pump. The invention thus provides a pump that requires little or no more installation space in the axial direction than a pump for only one delivery stream in the conventional design, but which produces two delivery streams, each of which can be regulated independently of the other and if necessary is adjustable in case of need, and which has only one cylindrical drum, thus few components to be produced. If all the cylindrical holes are parallel to each other, little or no more expenditure is required for producing the cylindrical drum of the pump according to the invention than for the production of a cylindrical drum of conventional construction.

It should be noted that the prior art does provide a hydrostatic drive unit in which there are two sets of pistons located on two different pitch circles wherein the pistons which are located on the larger pitch circle are assigned to a pump and the pistons located on a smaller pitch circle are assigned to a motor. Here each cylinder lying on the large pitch circle is connected directly with a cylinder lying on the small pitch circle and the cylindrical drum has no control mechanism for regulating a stream of fluid, i.e., no control rotary slide valve (control level) either. With regard to the three-dimensional situation, the tapered washer of the hydraulic motor is not adjustable (DE-OS No. 20 48 637). In contrast, the design with a cylindrical drum according to the present invention permits producing two delivery streams while avoiding the shortcomings of the above state of the art, and in which each delivery stream can be regulated independently of the other by adjusting the appropriate tapered washer body. Through the combination of the characterizing features, it thus becomes possible to utilize pistons on two different pitch angles, which is familiar in itself for drive units, for producing two independently regulatable streams, in which case all the features expediently work together to achieve the goal.

In addition, another tapered washer pump is also known in the prior art, with a rotating cylindrical drum in which cylindrical holes are located on two pitch diameters, and which delivers two streams. Although a control rotary slide valve is present, additional valves are necessary in this pump; the stream delivered is carried away by the shaft. All the pistons run jointly against a single tapered washer. The result of this is that (1) no adjustment is possible, and (2) there is no possibility for separate adjustability of the piston strokes at all (British Pat. No. 1,127,291).

It should also be noted that an axial piston pump that serves to deliver two streams that can be adjusted in common and are independent of each other with respect to pressure and in which two approximately semi-circular channels ("pockets") are located in pairs on two diameters in the control level and the mouths of the channels connected with the cylindrical drums are located on two corresponding pitch diameters, such that the mouth of every second cylinder lies on the small pitch diameter and the mouth of each intermediate cylinder lies on the large pitch diameter, is also known. The semi-circular channels of large diameter pertain to a pressure-medium circulation, and the channels in between belong to a different one (DE-OS No. 16 53 634). Since only one half of the cylinder is assigned to each pressure-medium circulation, each delivery stream is half as great as would be possible with a cylindrical drum of identical dimensions in normal performance. Because all the pistons necessarily run against one tapered washer, adjustment of one circuit independently of the other is impossible.

In order that the tapered washer contact surface, on which the pistons located on the large pitch are run according to the invention, can have as small a diameter as possible, the tapered washer body against whose tapered washers the pistons that are located on the smaller pitch diameter are supported must be in the form of a spherical segment or calotte on the back side, because a semi-cylindrical shape of the tapered washer body as was conventional to date would result in the outer corners of this tapered washer body projecting very far outward. However, because these outer corners may not be slipped over by the pistons or the slippers of the pistons on the larger pitch diameter, the inner diameter of this contact surface for the pistons located on the very large pitch diameter should be very large and this would run against the desired goal of ending up with as small an installation space as possible. It would also be conceivable for the back side of the tapered washer body assigned to the pistons located on the smaller diameter to have a different shape, perhaps that of a double cone or especially that of an ellipsoid, so that the tapered washer has an ellipse-shaped boundary, which would be favorable with respect to the relative path of the pistons in inclined tapered washers. However, such a form differing from the spherical would make it impossible to utilize the advantage inherent in having the regulation unit and final control unit swivel around two axes at right angles to each other and the production of such a shape of the tapered washer body and the recess in the outer tapered washer body would also be very expensive, at least for an ellipsoid-like shape. Spherical segment- or calotte-shaped bearing points on axial piston machines have been known to date only in quite different form in drive-flange machines, in which a pear-shaped housing with a semi-spherical hollow section supports a spherical segment- or calotte-shaped section of the drive-flange bearing point (DE-PS No. 971,352).

The bearing or support system of the tapered washer body assigned to the pistons located on the large pitch diameter can be effected in any known manner. This means that it can, as is known, be in semi-cylindrical form or be supported on lugs, or it can also be spherical segment- or calotte-shaped on its back side as the tapered washer body assigned to the pistons on the small pitch diameter.

The ability of the regulating unit and final control unit to cause the washer or swash plate to swivel around two axes at right angles to each other permits the support of the tapered washer body assigned to the pistons located on the small pitch diameter such that it can not only be swivelled around an axis in order to adjust the stroke, but can also be displaced by a small angle around the third axis perpendicular to this axis and acting as the axis of rotation. By means of such an additonal swivelling, the piston dead center position can be shifted with respect to the center of the separating web in the case of a fixed control level and thus a precompression or pre-expansion can be effected, by which the processes in the cylinder during the slipping over of the separating web, i.e., during the reversing process, can be improved. This swivelling around the second axis can be effected as a function of the delivery pressure, such that the precompression or pre-expansion takes place as a function of the pressure gradient and thus an optimal situation is achieved both with regard to efficiency and also noise production.

If the tapered washer body assigned to the pistons located on the large pitch diameter is also in the form of a spherical segment or calotte on its back side and is supported in a corresponding seat, it can also be swivelled around this second axis independently of the other internal tapered washer body and thus the reversing process can be improved, corresponding to the pressure against which it is delivered.

Both tapered washer bodies are expediently insured against rotation under the action of friction of the piston slippers by means of elements that are familiar in themselves.

The difference in the pitch diameters can be relatively small, such that when it is displaced by a half spacing a cylinder located on the large pitch diameter lies between two cylinders located on the small pitch diameter, in which case the inner edge of the cylinder of the axis of rotation of the cylinder located on the large pitch diameter has a smaller distance from the axis of rotation than the outer edge of the cylinder located on the small pitch diameter. Thus, twice as many cylinders as are provided on each pitch diameter can be present with a relatively small outside diameter of the cylindrical drum, provided the slippers are sufficiently small that sufficient space is available in their region or the cylinders located on the large pitch diameter are not parallel to the axis of rotation, but the cylinder axes lie on the surface of an imaginary pointed cone, whose apex lies beyond the cylindrical drum on the control level side. However, if the difference in diameters of the pitch circles is greater, so that a cylinder lying on the small pitch diameter and a cylinder lying on the large pitch diameter can lie side by side in a radial section passing through the axis of rotation of the cylindrical drum, there is then greater freedom with regard to selecting the number of cylinders lying on the individual pitch diameters.

Pocket-like recesses connected with pressure-medium feed lines can be provided in the outer surface of the spherical segment or calotte on the back side of the tapered washer body and/or in the hollow spherical surface in which it is supported in order to form pressure cushions for a hydrostatic bearing system, which reduces the friction between the tapered washer body and the bearing and thus facilitates a regulation and also insures that the tapered washer body assigned to the piston located on the smaller pitch diameter can be adjusted without exerting forces on the tapered washer body assigned to the piston located on the large pitch diameter.

Folded wings can also be provided directly on the tapered washer body for swivelling it, in which case the tapered washer body assigned to the piston located on the smaller pitch diameter is provided with a wing that slides in a sealed manner in a longitudinal recess of the other tapered washer body, or this other tapered washer body assigned to the piston located on the large pitch diameter can be provided with a folded wing that slides in a sealed manner in a corresponding recess of the housing, in which case the folded wing divides the recess into two pressure chambers that can be arbitrarily loaded with pressure. In such a folded wing drive it is expensive to facilitate a swivelling around the second axis according to claim 2 because in this case the folded wing must in turn be supported in a laterally displaceable manner on the tapered washer body. Such folded-wing drives are known on semicylindrical rocking devices (DE-OS No. 24 51 380).

If the cylindrical holes on the large pitch diameter have the same hole diameter as the cylindrical holes on the small pitch diameter, a larger delivery stream can be produced with the cylinders lying on the larger pitch diameter than with the cylinders lying on the smaller pitch diameter because a large piston stroke is attainable on the larger pitch diameter if there is no limitation for other reasons, e.g., due to the piston length or with regard to a different swivellability of the tapered washer body. If it is required that both delivery streams be approximately the same size, the cylinders lying on the large pitch diameter can have smaller hole diameters. It must be borne in mind here that the pistons lying on the large pitch diameter or the ratios at the cylinder mouths assigned to them will represent the limit for the r.p.m.

Several preferred embodiments of this invention are illustrated in the accompanying drawings which:

Figure 1:
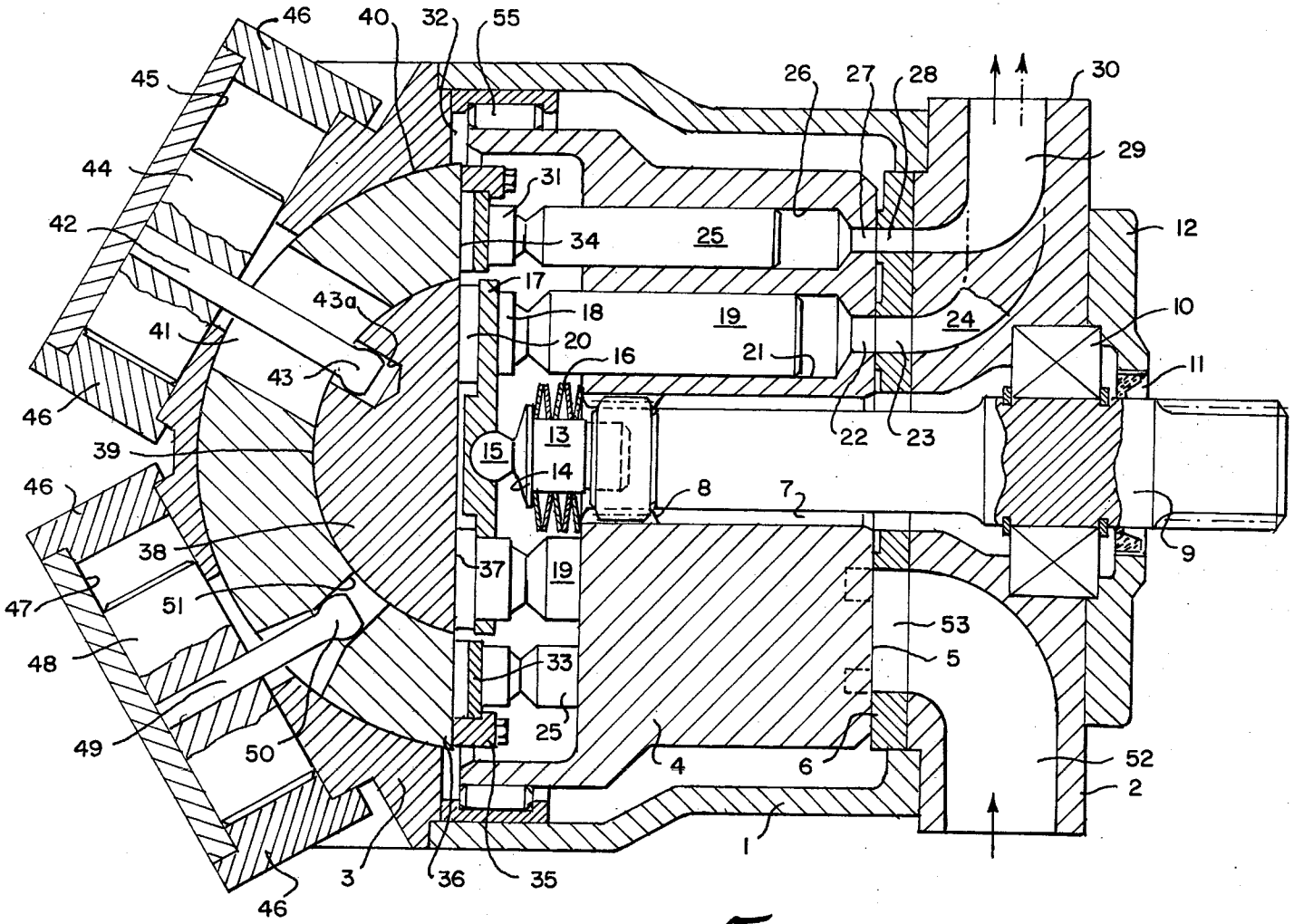
FIG. 1 is a section through an axial piston pump according to this invention.
Figure 2:
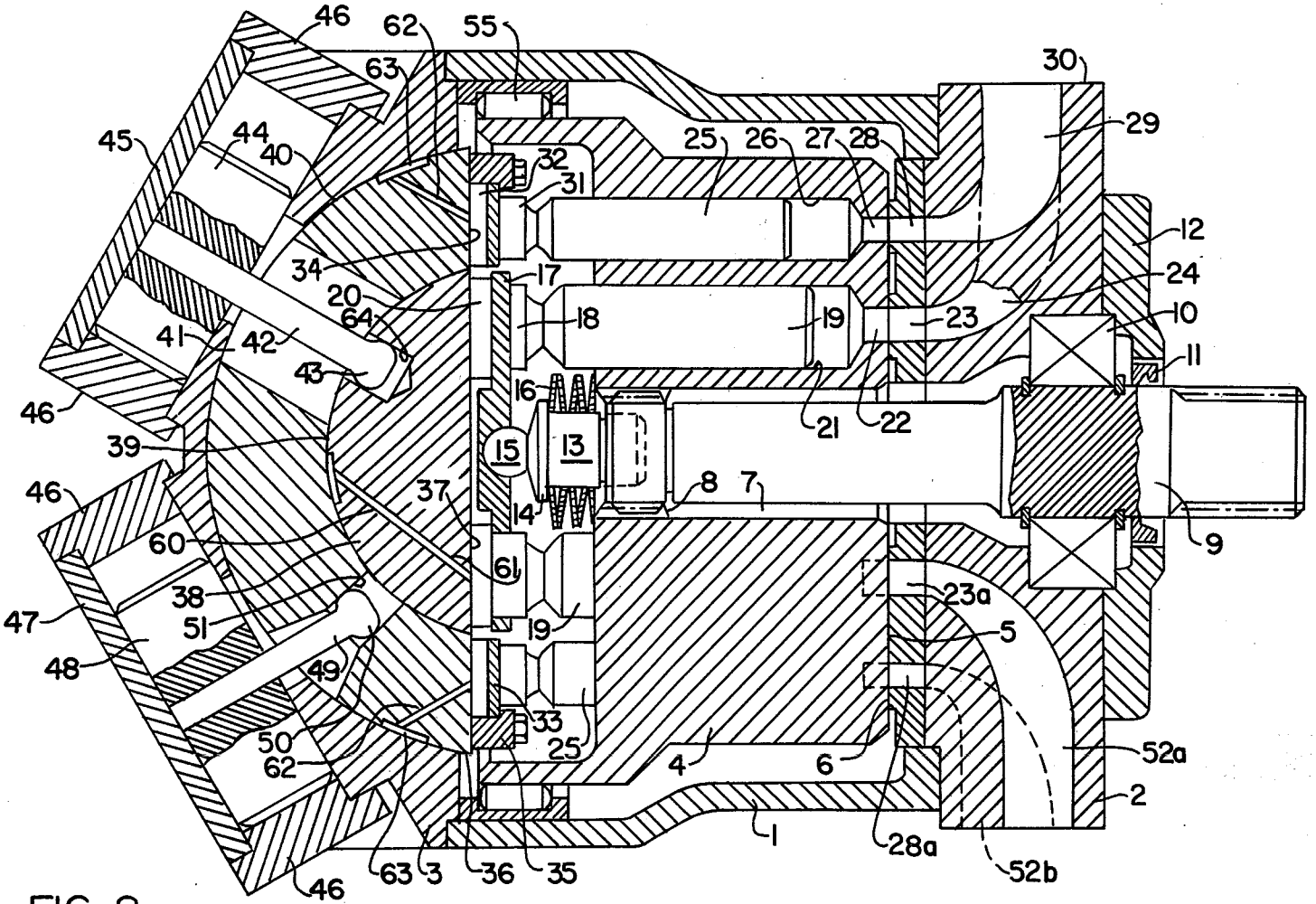
FIG. 2 is a section through a second embodiment of axial piston pump according to the invention.
Figure 3:
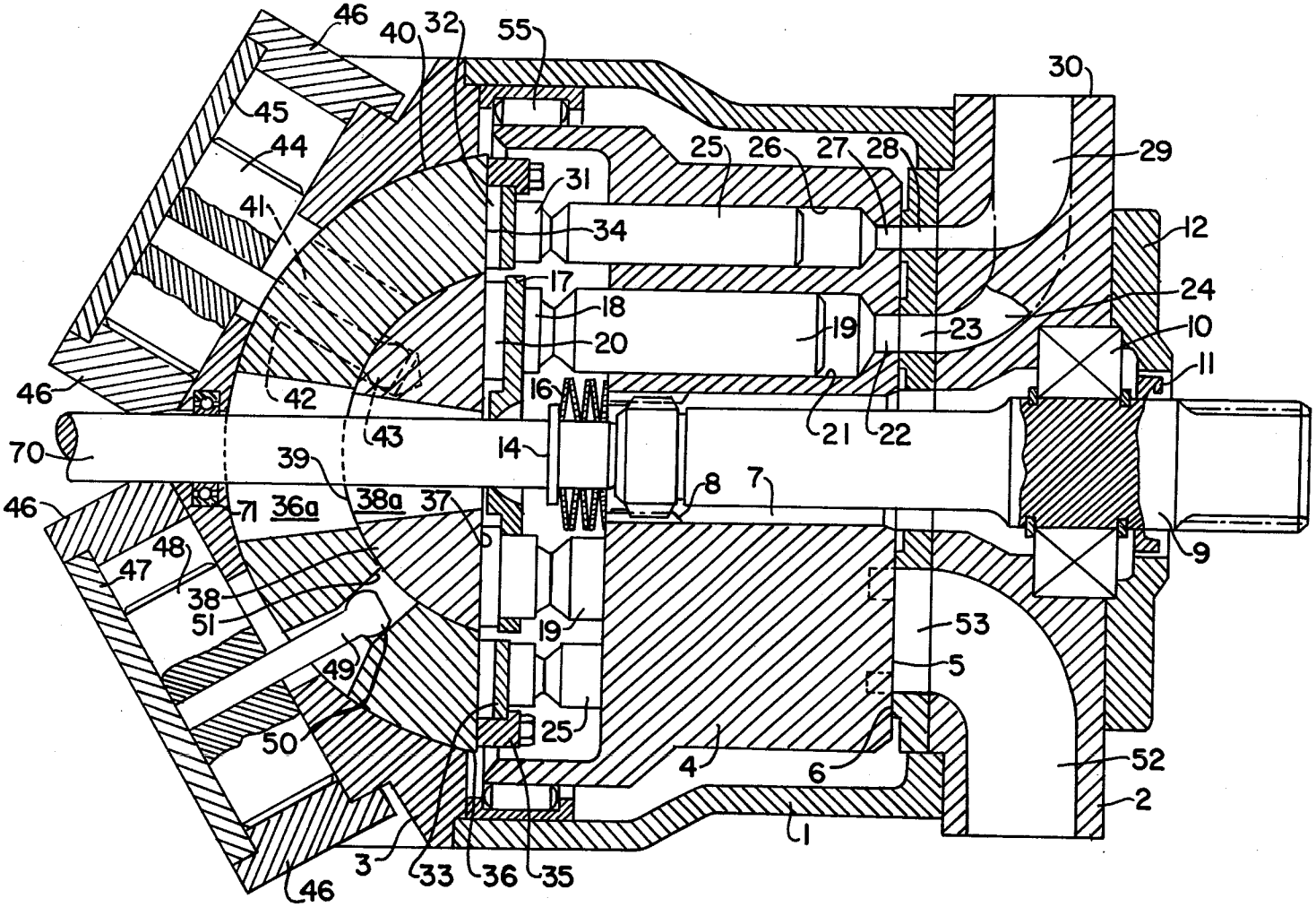
FIG. 3 is a section through a third embodiment of axial piston pump according to this invention.

In the drawing there is illustrated a control plate 2 mounted on one side of the housing midsection 1 and the rocker bearing section 3 is mounted on the other side. These sections are joined together by anchor bolts (not shown in the drawing).

The cylindrical drum 4 is supported in the housing midsection 1 by means of a roller bearing 55. The cylindrical drum 4 lies with its end face 5 against a control plate 6, which is in turn supported in a nonrotatable manner on the control plate section 2. The cylindrical drum 4 has a longitudinal borehold 7, which is provided in its section to the left-hand side in the drawing with an internal toothing 8 that engages in the teeth of a drive shaft 9, which in turn is supported by means of a bearing 10 (which is preferably designed as a roller bearing pair) in the control plate 2. The cover 12 serves to secure the bearing 10 and carries the seal 11.

A lug 13, which has a collar 14 and a spherical head 15, is provided coaxially to the shaft 9. A plate spring set 16 is supported against the collar 14 and also against the cylindrical drum 4. The spherical head 15 lies in a corresponding recess of the pressure plate 17, which has holes through which the slippers 18 of the pistons 19 located on the small pitch diameter project. The slippers 18 have a base section 20, against which the pressure plate 17 presses.

The pistons 19 located on the smaller pitch diameter are capable of moving in the cylindrical holes 21, in which case each cylindrical hole 21 is provided with an orifice channel 22, which empties into the end face 5 of the cylindrical drum 4, opposite an at least approximately semi-circular channel 23 in the control plate 6, which continues in a channel 24 in the control plate 2, in which case the channel 24 leads to a connection lying beside the plane of the drawing (not shown in the drawing).

The pistons 25 are located on a larger pitch diameter than the pistons 19, in which case each of the pistons 25 is capable of displacement in a cylindrical hole 26, which has an orifice channel 27, where the orifice channels 27 lie opposite an approximately semi-circular channel 28 in the control plate 6, in which case the channel 28 connects to a channel 29 in the control plate section 2, which leads to a connection flange 30 for a feed pressure line (not shown in the drawing).

Each piston 25 is supported against a slipper 31, the base section 32 of which is pressed by a hold-down ring 33 against the tapered washer 34, in which case the hold-down ring 33 is held by a pressure ring 35, which is bolted against the tapered washer body 36. The tapered washer 34 assigned to the piston 25 located on the larger pitch diameter is thus formed on the tapered washer body 36. In contrast, the pistons 19 located on the smaller pitch diameter are supported against the tapered washer 37 by means of their slippers 18; the tapered washer 37 is formed on the tapered washer body 38, which has on its back side a calotte-shaped surface 39, which rests in a hollow spherical surface of the tapered washer body 36. The latter has on its back side a semi-cylindrical surface 40, which rests in a hollow cylindrical surface of the rocker bearing section 3.

The tapered washer body 36 has a recess 41, through which an adjustable pin 42 passes; the latter is provided with a spherical head 43, which is guided in a hole 43*a* of the tapered washer body 38. The adjustable pin 42 is on the other hand secured in the adjusting piston 44, which is displaceable in the operating cylinder 45, which is formed in a corresponding continuation of the rocker bearing section 3 and is closed on both sides by covers 46, through which pressure-fluid lines (not shown in the drawing) pass, by means of which the adjusting piston 44 can be arbitrarily loaded with pressure medium.

Another continuation is formed on the rocker bearing section 3, in which there is an operating cylinder 47 in which an adjusting piston 48 is capable of displacement. The operating cylinder 47 is also closed by two lids 46. An adjustable pin 49, which engages with its spherical head section 50 in a hole 51 of the tapered washer body 36, is fastened in the adjusting piston 48.

In the design shown in the drawing of the dual pump for two open circulations a suction channel 52 is provided in the control plate section 2; this channel 52 empties in front of a broad opening 53 of the control plate 6, in which case the opening 53 extends so far in the radial direction that it lies in front of both orifice channels 27 and orifice channels 28. The recess 53 extends just as far in the circumferential direction as the approximately semi-circular channels 23 and 28 on the other side.

In a modified implementation form two approximately semi-circular channels, which correspond to channels 23 and 28, can also be formed in front of the mouth of the suction channel 52, in which case the side of the control plate 6 facing the suction channel 52 is favorable to flow. In another modification of the implementation form the control section 2 is symmetric on both sides, that is, instead of the single suction channel 52 and the recess 53, two separate channels 52*a* and 52*b* are formed in the control plate section 2 and correspondingly two approximately semicircular channels 23*a* and 28*a* corresponding to the channels 23 and 28 in the control plate 6, so that the pump is designed for two closed circulations.

The control plate section 2 is shown in the usual manner, displaced by 90° around the axis of shaft 9, because in the sectional plane that is perpendicular to the swivelling axis of the tapered washer bodies 36 and 38 the separating webs lie in the control plate 6, i.e., no openings could be detected in the drawing if the section were laid through this.

The tapered washer body 38 operating pistons 19 located on the smaller pitch diameter may be supported by hydrostatic bearings formed by a recess 60 and bore hole 61 between recess 60 and face 37 to connect with the receiving seat of the tapered washer body 36 operating pistons 25 on the larger pitch diameter. It is also possible to connect the two tapered washer bodies 36 and 38 together by detachable means for the purpose of common adjustment.

In another embodiment the two tapered washer bodies 36 and 38 could be provided with a central recess 36*a* and 38*a* in each, through which an extension 70 of the shaft 9 connected with drum 4 might pass freely and be journalled in bearing 71 in section 3.

In the foregoing specification certain preferred practices and embodiments of this invention have been set out, however, it will be understood that this invention may be otherwise embodied within the scope of the following claims.

I claim:

1. An axial piston pump for producing two streams that can be regulated independently of each other with respect to size and pressure comprising a housing, a revolving cylindrical drum in said housing, a drive shaft connected to said drum for rotating the same, a plurality of spaced holes in said drum on two different pitch diameters generally parallel to the drum axis and opening to a common end face of said drum, a plurality of pistons reciprocable in said holes, a rotary slide control valve acting on the opposite end face of said drum, a first tapered washer bearing on one end of said pistons moving in the holes of the smaller pitch diameter, a second tapered washer surrounding the first tapered washer and bearing on one end of the pistons moving in the holes of larger pitch diameter, means engaging said first and second tapered washers independently to move them relatively to one another at an angle to the axis of the drum and a pair of separate outlet ports on said rotary valve receiving fluid independently from each of the pistons of different pitch diameter and delivering the same from the pump, said control rotary slide valve having a first generally semi-circular channel at least on the discharge side communicating with the piston and holes located on the smaller pitch diameter and a second separate generally semi-circular channel communicating with the pistons and holes located on the larger pitch diameter and two separate discharge lines, one connected to each of said channels, said two tapered washer bodies being of generally hemispherical shape, the one of smaller pitch diameter rotatably received in a hemispherical recess of the one of larger pitch diameter.

2. An axial piston pump as claimed in claim 1 having control means on said housing acting on said second washer for adjusting the same, said washer being movable around two axes at right angles to each other.

3. An axial piston pump as claimed in claim 1 wherein the first tapered washer is supported by hydrostatic bearing in the second tapered washer.

4. An axial piston pump as claimed in claim 1 having connecting means between said first and second tapered washer bodies whereby said bodies can be detachably connected together for the purpose of a common adjustment.

5. An axial piston pump as claimed in claim 1 wherein both of said tapered washers have a central recess through which the drive shaft passes.

6. An axial piston pump as claimed in claim 1 having control means on said housing acting on said first washer for adjusting the same, said washer being movable around two axes at right angles to each other.

7. An axial piston pump as claimed in claim 6 having control means.

* * * * *